US005230231A

United States Patent [19]

Liou

[11] Patent Number: 5,230,231

[45] Date of Patent: Jul. 27, 1993

[54] PADLOCK

[76] Inventor: Gaieter Liou, No. 48, Ton Hwa St., San-Min Dist., Kaohsiung, Taiwan

[21] Appl. No.: 921,767

[22] Filed: Jul. 30, 1992

[51] Int. Cl.[5] ..... E05B 67/22

[52] U.S. Cl. ..... 70/38 A; 70/39; 70/52

[58] Field of Search ..... 70/38 A, 39, 52

[56] References Cited

U.S. PATENT DOCUMENTS

| | | | |
|---|---|---|---|
| 957,033 | 5/1910 | De Bruycker | 70/38 A |
| 1,566,473 | 12/1925 | Gibson | 70/38 A |
| 2,136,435 | 11/1938 | Habram et al. | 70/52 |
| 2,419,213 | 4/1947 | Hines | 70/38 A |
| 4,693,099 | 9/1987 | Cykman | 70/247 |

FOREIGN PATENT DOCUMENTS

| | | | |
|---|---|---|---|
| 86122 | 11/1921 | Austria | 70/52 |
| 2736984 | 3/1979 | Fed. Rep. of Germany | 70/39 |
| 953722 | 12/1949 | France | 70/38 A |
| 428570 | 12/1947 | Italy | 70/38 A |
| 2054021 | 2/1981 | United Kingdom | 70/38 A |

*Primary Examiner*—Lloyd A. Gall

*Attorney, Agent, or Firm*—Jacobson, Price, Holman & Stern

[57] ABSTRACT

A padlock structured to have a key inserting direction perpendicularly to the shackle moving direction. The padlock has an outer housing with a hollow post extending from a side wall and the shackle extending from the top wall. The key is inserted sideways into a deadbolt contained in the post. The deadbolt operates two control members which engage and disengage notches in opposite limbs of the shackle.

2 Claims, 2 Drawing Sheets

PADLOCK

BACKGROUND OF THE INVENTION

A conventional padlock is generally structured to have a key inserting direction parallel to a shackle moving direction, so it is rather ,difficult to use for items having a comparatively small operating, because the lack needs a rather large space for its 1. 8 its key to move in locking and unlocking direction.

SUMMARY OF THE INVENTION

An object of this invention is to provide which does not need as large a space for its shackle and key to move in locking and unlocking directions as a conventional padlock.

The padlock in the present invention comprises a housing, an inner case secured in the housing and a U-shaped shackle as its main components.

The housing is made of a hard material, having a dead bolt rotatably installed in a hollow post extending sidewise from a vertical side of the housing. The dead bolt extends in a cavity in the inner case, and two L-shaped control members are installed in the cavity with a coiled spring interposed between the two control members to push and move the two control members to extend their outer ends in two notches in the shackle so that shackle may be kept immovable as locked. The two control members in locked position can be pushed inward by rotation of the dead bolt by a key so that the outer ends of the two control members may separate from the notches in the shackle, freeing the shackle to be pulled out of the inner case and the housing, in other words, unlocking the padlock.

BRIEF DESCRIPTION OF DRAWINGS

This invention will now be described in detail with reference to accompanying drawings wherein.

DETAILED DESCRIPTION OF THE INVENTION

Figure 1:
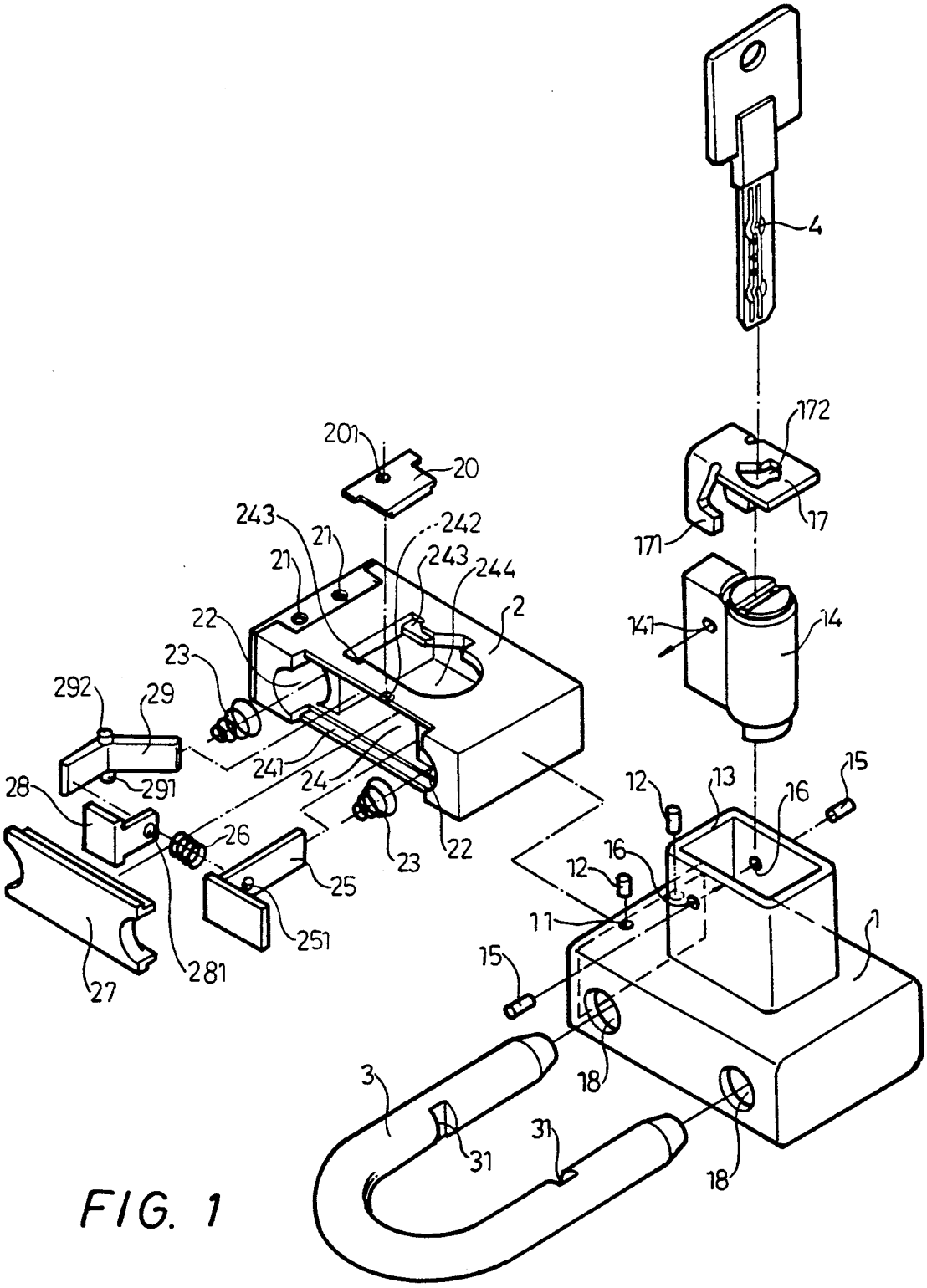
FIG. 1 is an exploded perspective view of a padlock of the present invention.

The padlock in the present invention, as shown in FIG. 1, comprises a housing 1, an inner case 2 and a shackle 3 as its main components.

The housing 1 is made of a hard metal to contain the inner case 2, having two holes 11 for two pin nails 12 to pass through to fit in two holes 21 in the inner case 2 for combining securely the inner case 2 with the housing 1. The housing 1 also has a hollow rectangular-shaped post 13 extending sidewise from one side wall for containing and protecting a dead bolt 14 in the post 13, two pins 15 passing through two opposite holes 16 in two opposite sides of the post 13 and also through a hole 141 in the dead bolt 14 to secure the dead bolt 14. The dead bolt 14 is capped with and protected by a lid 17, which has a foot 171 extending down and irremovable removably engaged by the pin 15, and a key hole 172 for a key to pass through to lock or unlock the dead bolt 14. The housing 1 also has two holes 18 spaced apart in an upper wall of the housing for two ends of the U-shaped shackle 3 to move in and out thereof.

The inner case 2 has two holes 21 for the pin nails 12 to pass through to secure the inner case 2 with the housing 1, two lengthwise shackle holes 22 spaced apart corresponding to the two holes 18 in the base 1 for the shackle 3 to extend therein. A coiled spring 23 is placed on the bottom of each hole 22 to elastically push forward the shackle 3 when the shackle 3 is released for movement by unlocking the dead bolt 14. The inner case 2 also has a cavity 24 for containing two L-shaped control members 25, 28 and an actuating plate 29. The control members 25, 28 each have a projection 251, 281 on their lengthwise portions for a respective end of a coiled spring 26 to fit around and extend elastically between the lengthwise portions of the control members 25, 28. The lateral portions of the two control members 25, 28 fit and move in a lateral straight groove 241 provided at the opening of the cavity 24, and the lengthwise portions of the control members 25, 28 can be elastically pressed by the spring 26 to both sides, pushing the outer ends of their lateral portions into the shackle holes 22. A shaft hole 242 is provided in the upper wall near the opening of the cavity 24 for a pivotal pin 291 at the bottom of the actuating plate 29 to enable the actuating plate 29 to rotate for a certain angle with the pivotal pin 291 as a pivot. The actuating plate 29 also has another pivotal pin 292 at the top to insert in a pin hole 201 in a limit plate 20 to keep the limit plate 20 secured in a recess 243 in the upper surface of the inner case 2. So the limit plate 20 cannot fall off the actuating plate 29 is bent a little at its intermediate portion, with its one end positioned between the inner wall of the control member 28 and the side wall of the cavity 24, and with its other end resting on the outer wall of the control member 25, as shown in FIG. 3.

After the control members 25, 28, the spring 26 and the actuating plate 29 are assembled in the cavity 24, a cap 27 is fitted on the opening of the cavity 24 so that the control member 25 may be restricted to move in the cavity 24. The inner case 2 also has an opening 244 in the upper wall, communicating with the cavity 24 and with the hollow post 13 in the housing 1 to enable the dead bolt 14 to extend deeply in the cavity 24 to contact the control member 25. The dead bolt 14 has its bottom shaped as a semi-circle, usually having its flat diametrical surface in contact with the outer side of the control member 25 as shown in FIG. 3. When the dead bolt 14 is rotated, its upper corner where the flat surface and the semi-circular surface meet gradually pushes the control member 25 to move inward as shown in FIG. 4.

The shackle 3 is made of a hard metal, having a U shape and two notches 31 in its opposite inner sides for the outer ends of the lateral portions of the control members 25, 28 to engage in so that the shackle 3 may be kept immovable with its two ends inserted in the inner case 2.

Figure 3:
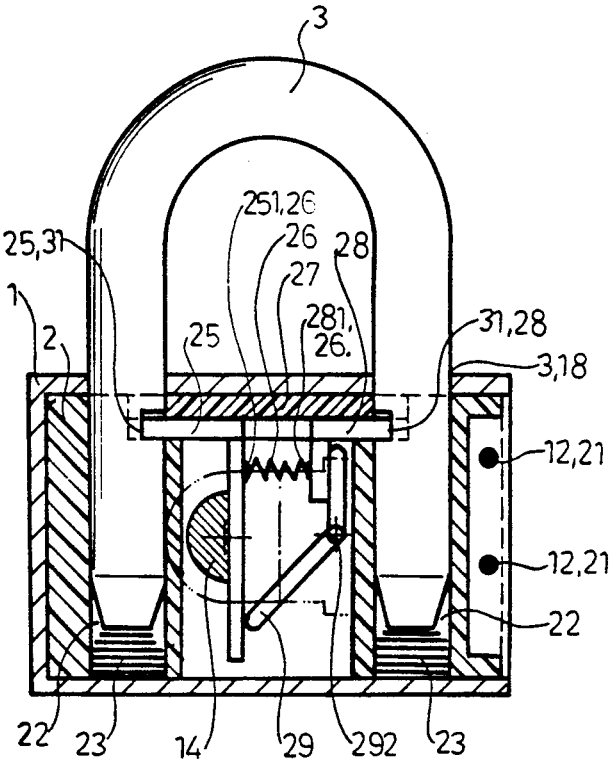
FIG. 3 is a cross-sectional view on line 3—3 of FIG. 2.
Figure 2:
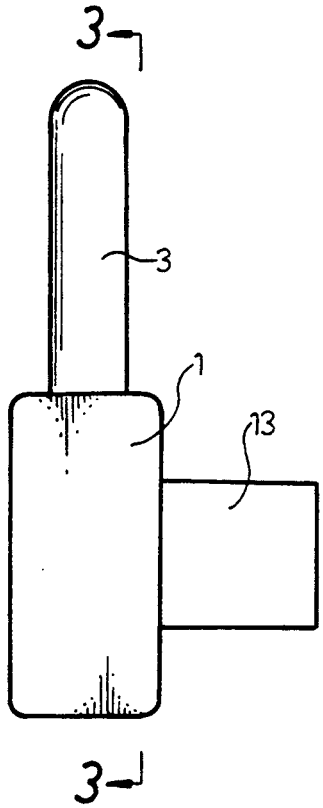
FIG. 2 is a side view of the padlock in locked condition.

FIGS. 2 and 3 show the padlock in locked condition wherein the shackle 3 is pushed into the inner case 2, the control members 25, 28 are pushed to move outward by the spring 26, having the outer ends of the lateral portions protruding into the two notches 31 in the shackle 3, which is then locked. The padlock is thus in locked condition.

Figure 4:
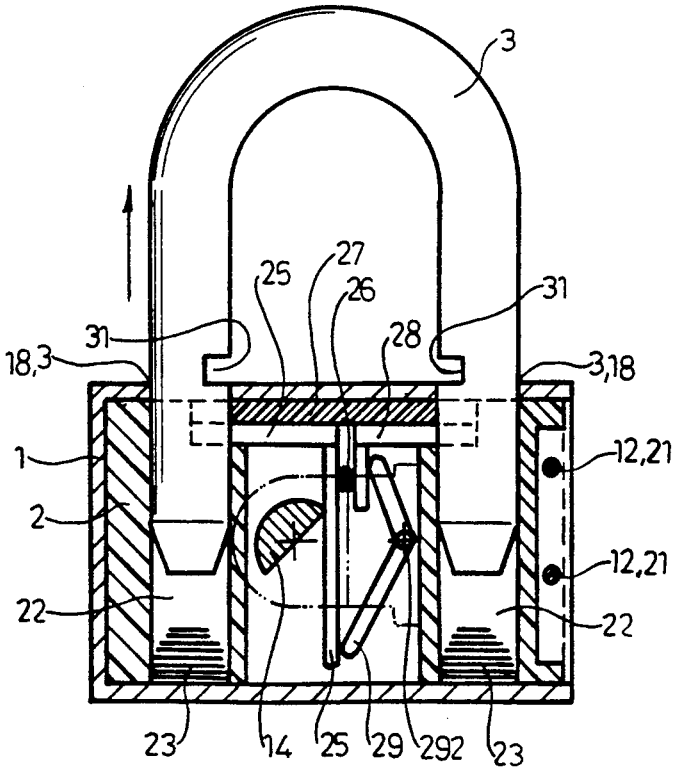
FIG. 4 is a cross-sectional view of the padlock with its shackle being unlocked.

FIG. 4 shows the padlock in unlocked condition, wherein the dead bolt 14 is rotated by a key from the position shown in FIG. 3, and the upper corner of the dead bolt 14 pushes the control member 25, which is then moved inward to compress the spring 26 and at the same time to press the lower end of the actuating plate 29 so that the control members 25, 28 are forced to move toward each other, withdrawing the outer ends of their lateral portions from the notches 31. Then the shackle 3 is in open condition, separatable from the inner case 2 and the housing 1.

As the key inserting direction is perpendicular to the moving direction of the shackle, the padlock, is convenient for locking or unlocking items that have a small space for movement of the shackle and the key.

What is claimed is:

1. A padlock comprising;

a housing made of a hard material to contain an inner case secured firmly in the housing, a rectangular hollow post extending sidewise from a side wall of the housing and two shackle holes spaced apart in an upper wall of the housing for two ends of a shackle to pass through;

a dead bolt being installed in said rectangular hollow post and capable of being rotated by a key, the dead bolt having a semi-circular bottom extending in a cavity in said inner case to touch one of two L-shaped control members;

said inner case being secured firmly in said housing and having two spaced apart further shackle holes for two end portions of said shackle to move in and out, a cavity between said two further shackle holes for said two L-shaped control members and an actuating plate to be installed therein;

said shackle having two opposite notches in its inside surfaces for receiving two outer ends of lateral portions of said two L-shaped control members; and said two L-shaped control members having their lengthwise portions pinching a coiled spring therebetween, one of said L-shaped control members having an inner surface of its lengthwise portion contacting the semi-circular bottom of said bead bolt, the other of said L-shaped control members having an inner surface of its lengthwise portion facing an upper end of the actuating plate which is bent at an intermediate portion, a lower end of the actuating plate resting on an outer surface of the lengthwise portion of said one of said L-shaped control members, and said actuating plate being rotatable on a pin shaft provided at the intermediate portion as a pivot.

2. The padlock as claimed in claim 1, wherein said cavity between said two further shackle holes is closed by a cap.

* * * * *